US009119490B1

(12) United States Patent
Parodi, Jr.

(10) Patent No.: US 9,119,490 B1
(45) Date of Patent: Sep. 1, 2015

(54) CLIP ON SHOT GLASSES AND CLIP ON POCKETS

(71) Applicant: GETMUGSHOT, Inc., Costa Mesa, CA (US)

(72) Inventor: John Parodi, Jr., Costa Mesa, CA (US)

(73) Assignee: GetMugShot, Inc., Costa Mesa, CA (US)

( * ) Notice: Subject to any disclaimer, the term of this patent is extended or adjusted under 35 U.S.C. 154(b) by 0 days.

(21) Appl. No.: 14/340,978

(22) Filed: Jul. 25, 2014

Related U.S. Application Data

(60) Provisional application No. 61/937,115, filed on Feb. 7, 2014, provisional application No. 61/970,604, filed on Mar. 26, 2014.

(51) Int. Cl.
*A47G 23/06* (2006.01)
*A47G 19/22* (2006.01)
*B65D 25/20* (2006.01)

(52) U.S. Cl.
CPC ..... *A47G 19/2205* (2013.01); *A47G 23/06* (2013.01); *B65D 25/20* (2013.01)

(58) Field of Classification Search
CPC ..... B65D 25/20; A47G 23/06; A47G 19/2205
USPC ..... 220/4.26, 575, 751
See application file for complete search history.

(56) References Cited

U.S. PATENT DOCUMENTS

| | | | |
|---|---|---|---|
| 256,231 | A | 4/1882 | Mackey |
| D33,218 | S | 9/1900 | Dixon |
| 757,645 | A | 4/1904 | Bassett |
| 1,499,452 | A | 7/1924 | Gay |
| 1,692,951 | A | 7/1926 | Pinckney |
| 1,798,339 | A | 10/1928 | Soulis |
| 1,762,331 | A | 1/1929 | Greist |
| 1,772,176 | A | 8/1930 | Benjamin |
| 1,948,932 | A | 9/1930 | McMickle |

(Continued)

FOREIGN PATENT DOCUMENTS

WO 2011006976 1/2011

OTHER PUBLICATIONS

Beverage Industry, Jun. 2014, bevindustry.com, pp. 68-69.

(Continued)

*Primary Examiner* — Fenn Matthew
*Assistant Examiner* — Elizabeth Volz
(74) *Attorney, Agent, or Firm* — Brian S. Steinberger; Law Offices of Brian S. Steinberger, P.A.

(57) ABSTRACT

Attachable and detachable shot glass and pocket type accessories having a clip on one side for allowing the shot glass type accessories to securely clip onto exterior edges of larger beverage containers, such as glasses, plastic container, paper and cardboard cups, while keeping top of the shot glass and the liquid contents in the shot glass level with the top of and the liquid contents in the larger beverage container, such as beverage glasses, coffee and tea and beverage cups, on insulation sleeves on cups, and the like. The shot glass can hold extra liquids, such as alcohol and non-alcohol therein, as well as hold sweeteners, creams, and the like. The shot glass is attachable to containers of other edible substances, such as desserts to hold toppings in the shot glasses. Shot glasses can be used to hold paints clipped on a container holding painting supplies, such as brushes.

20 Claims, 14 Drawing Sheets

(56) References Cited

U.S. PATENT DOCUMENTS

| | | | |
|---|---|---|---|
| 2,278,401 | A | 3/1942 | Micari |
| 2,314,835 | A | 3/1943 | Johns |
| D139,569 | S | 5/1944 | O'Brien |
| 2,646,200 | A | 6/1945 | Atkins |
| 2,613,517 | A | 7/1949 | Frantz |
| 2,680,557 | A | 6/1954 | Madden |
| 2,740,576 | A | 4/1956 | Franck |
| 2,787,408 | A | 4/1957 | Andre |
| 2,856,113 | A | 10/1958 | Brumby |
| 3,219,226 | A | 11/1965 | Schroeder |
| 3,630,430 | A | 12/1971 | Struble |
| 3,754,502 | A | 8/1973 | Kaufman |
| 3,850,398 | A | 11/1974 | Kantor |
| 4,410,129 | A | 10/1983 | Wischusen |
| 4,436,217 | A | 3/1984 | Ritter |
| 4,535,921 | A | 8/1985 | Sanders |
| D290,919 | S | 7/1987 | Beute |
| D302,050 | S | 7/1989 | Ingrisani |
| 4,854,466 | A | 8/1989 | Lane, Jr. |
| 4,989,742 | A | 2/1991 | Powell |
| 5,137,210 | A | 8/1992 | Hibbs |
| 5,184,750 | A | 2/1993 | Moller |
| 5,261,577 | A | 11/1993 | Goldstein |
| 5,297,695 | A | 3/1994 | Provence |
| 5,335,787 | A | 8/1994 | Finchum |
| 5,375,742 | A | 12/1994 | Mowry |
| 5,429,262 | A | 7/1995 | Sharkey |
| 5,651,523 | A | 7/1997 | Bridges |
| D385,462 | S | 10/1997 | Ferris |
| 5,687,873 | A | 11/1997 | Jones |
| D389,700 | S | 1/1998 | Bingham |
| D404,241 | S | 1/1999 | Bagley |
| D405,574 | S | 2/1999 | Riky |
| 5,924,615 | A | 7/1999 | McGarrah |
| 5,931,431 | A | 8/1999 | Stinnett |
| 6,068,181 | A | 5/2000 | Cai |
| 6,076,700 | A | 6/2000 | Manges |
| 6,152,362 | A | 11/2000 | Rosenfeld |
| 6,193,201 | B1 | 2/2001 | Babcock |
| D444,278 | S | 6/2001 | Myers, Jr. |
| 6,264,026 | B1 | 7/2001 | Bradley |
| 6,308,859 | B1 | 10/2001 | Johnson |
| 6,321,929 | B1 | 11/2001 | Weshler |
| 6,372,270 | B1 | 4/2002 | Denny |
| 6,394,297 | B1 | 5/2002 | Nance |
| D470,267 | S | 2/2003 | Groendyke |
| 6,533,232 | B1 | 3/2003 | Aggeler |
| 6,601,813 | B1 | 8/2003 | Kager |
| 6,606,996 | B1 | 8/2003 | Thornell |
| D484,363 | S | 12/2003 | De Groote |
| 6,672,817 | B2 | 1/2004 | Denny |
| 6,783,021 | B2 | 8/2004 | Kaura |
| 7,021,825 | B1 | 4/2006 | Schultz |
| D531,054 | S | 10/2006 | Sagel |
| D543,074 | S | 5/2007 | Luft |
| D557,413 | S | 12/2007 | Buermann |
| D573,412 | S | 7/2008 | Ablo |
| D577,615 | S | 9/2008 | Markfelder |
| D586,969 | S | 2/2009 | Graham |
| D610,408 | S | 2/2010 | Paolini |
| D623,019 | S | 9/2010 | Wildman |
| D625,961 | S | 10/2010 | Kent |
| 7,874,449 | B1 | 1/2011 | Studee |
| 7,980,406 | B2 | 7/2011 | Liu |
| D643,248 | S | 8/2011 | Schmidt |
| 8,061,545 | B2 | 11/2011 | Roth |
| D653,085 | S | 1/2012 | Swallow |
| D665,232 | S | 8/2012 | O'Connell |
| 8,443,996 | B2 | 5/2013 | Ciarrocchi |
| D684,429 | S | 6/2013 | Lion |
| D691,426 | S | 10/2013 | Brown |
| D694,905 | S | 12/2013 | Brown |
| D713,207 | S | 9/2014 | Hickox |
| 8,827,104 | B2 | 9/2014 | Hickox |
| 2002/0134781 | A1 | 9/2002 | Ciarrocchi |
| 2003/0019871 | A1* | 1/2003 | Nance ..... 220/23.4 |
| 2004/0031796 | A1 | 2/2004 | Krueger |
| 2006/0086756 | A1 | 4/2006 | Roth |
| 2007/0095843 | A1 | 5/2007 | Wu |
| 2007/0205199 | A1 | 9/2007 | Wothers |
| 2008/0035655 | A1 | 2/2008 | Baumgartner |
| 2009/0090710 | A1 | 4/2009 | Nielsen |
| 2009/0108004 | A1 | 4/2009 | Bollengier |
| 2011/0084087 | A1 | 4/2011 | Scribner |
| 2011/0272546 | A1 | 11/2011 | Nielsen |
| 2012/0097576 | A1 | 4/2012 | Dold |
| 2012/0199597 | A1 | 8/2012 | Myoung |
| 2012/0273509 | A1 | 11/2012 | Yao |
| 2012/0285952 | A1 | 11/2012 | James |
| 2013/0277375 | A1* | 10/2013 | Hickox ..... 220/575 |

OTHER PUBLICATIONS

Party Cup Sidecar, Party Sidecar Shotglass, RP & Associates, Inc., 2014, http://www.rpandassociates.com/drinkware/party-cup-sidecar, 2 pages.

The Hitch, Get Hitched, RP & Associates, Inc., 2014, http://www.rpandassociates.com/drinkware/the-hitch, 2 pages.

Beverage Industry Magazine features The Hitch, A new kind of sidecar, RP & Associates, Inc., 2014, http://www.rpandassociates.com/custom-drinkware/beverage-industry-magazine-features-t . . . , 2 pages.

Press Release: RP & Associates Unveils The Hitch, a Unique Way to Serve Shots & Gain Brand Recognition, RP & Associates, Inc., 2014, http://www.rpandassociates.com/custom-drinkware/press-release-rp-associates-unveils-the . . . , 2 pages.

Bar Supplies.com : Barconic (R) 2 oz. Assorted Plastic Shot Glass with Hook, 2014, retrieved from http://barsupplies.com/barconic-2oz-assorted-plastic-shot-glass-with-hook-p-16065.html, 5 pages.

Kelly, Japanese patent application No. 2012-520046, Preliminary report of issuance of a first office action from Japanese foreign counsel dated May 9, 2014, 3 pages.

* cited by examiner

CLIP ON SHOT GLASSES AND CLIP ON POCKETS

This application claims the benefit of priority to U.S. Provisional Patent Application Ser. No. 61/937,115 filed Feb. 7, 2014 and U.S. Provisional Patent Application Ser. No. 61/970,604 filed Mar. 26, 2014. The entire disclosure of each of the applications listed in this paragraph are incorporated herein by specific reference thereto.

FIELD OF INVENTION

This invention relates to beverage container accessories, and in particular to attachable and detachable shot glass and pocket type accessories having a clip formed on one side for allowing the shot glass type accessories to securely clip onto exterior edges of a larger beverage glass while keeping liquid contents in the shot glass level with liquid contents in the larger beverage glass.

BACKGROUND AND PRIOR ART

Shot glasses have generally been known to be small generally conical shaped flat bottomed glasses that can hold a shot of a beverage such as a shot of alcohol. Attempts have been made over the years to try to hang small shot glasses from a larger beverage glasses with a hook portion. However, these hanging shot glasses have problems making their usefulness not desirable.

For example, the hook hanging shot glass generally have inwardly tapering round exterior surfaces, which tend to cause the narrower diameter bottom of the shot glass to swing to an non-level and loose position against the tapering wall of a beverage glass, which can cause the contents of the shot glass to easily tilt and spill out. Additionally, the hook portions form a loose attachment point where the shot glass itself can easily fall off from the beverage glass.

Furthermore, the loose fitting hook and shape of the hook hanging shot glass does not allow for the larger beverage glass to be safely moved with the hook hanging shot glass hanging from one side. The loose attachment and shape of the hook hanging shot glass can easily result in the contents of the shot glass falling out and/or the shot glass easily falling from the larger beverage glass that it is being hung from. Thus, the need exists for solutions to the above problems with the prior art.

SUMMARY OF THE INVENTION

A primary objective of the invention is to provide attachable and detachable shot glass and pocket type accessories having a clip formed on one side for allowing the shot glass type accessories to securely clip onto exterior edges of a larger beverage glass while keeping liquid contents in the shot glass and pocket level with liquid contents in the larger beverage glass.

A secondary objective of the invention is to provide attachable and detachable shot glass and pocket having a clip formed on one side for allowing the shot glass and pocket to securely clip onto exterior edges of a larger beverage glass, which can increase sales of liquids being sold within the shot glasses and/or beverage glasses.

A third objective of the invention is to provide attachable and detachable shot glass and pocket having a clip formed on one side for allowing the shot glass and pocket to securely clip onto exterior edges of a larger beverage glass, and the shot glass and pocket being branded for advertisements.

A fourth objective of the invention is to provide attachable and detachable shot glass and pocket having a clip formed on one side for allowing the shot glass and pocket to securely clip onto exterior edges of a larger beverage glass, with the clip and shot glass and pocket being able to match the radius of the lip of any tapered beverage container.

A fifth objective of the invention is to provide attachable and detachable shot glass and pocket having a clip formed on one side for allowing the shot glass and pocket to securely clip onto exterior edges of a larger beverage glass, where the shot glass and pocket can stand alone as a 2 ounce drinking container.

A sixth objective of the invention is to provide attachable and detachable shot glass and pocket having a clip formed on one side for allowing the shot glass and pocket to securely clip onto exterior edges of a larger beverage glass, where the shot glasses and pockets are nestable with identical shot glasses and pockets for both easy packaging and reduced storage space needs.

A seventh objective of the invention is to provide attachable and detachable shot glass and pocket having a clip formed on one side for allowing the shot glass and pocket to securely clip onto exterior edges of a larger beverage glass, having a softened rounded edge on the clip radius of the drinking side of the shot glass and pocket.

An eighth objective of the invention is to provide attachable and detachable shot glass and pocket having a clip formed on one side for allowing the shot glass and pocket to securely clip onto exterior edges of coffee and tea cups.

An ninth objective of the invention is to provide attachable and detachable shot glass and pocket having a clip formed on one side for allowing the shot glass and pocket to securely clip onto exterior edges of paper and cardboard cups and plastic cups.

A tenth objective of the invention is to provide attachable and detachable shot glass and pocket having a clip formed on one side for allowing the shot glass and pocket to securely clip onto exterior edges of a food cup, such as a yogurt cup, parfait cup, and the like.

An eleventh objective of the invention is to provide attachable and detachable shot glass and pocket having a clip formed on one side for allowing the shot glass and pocket to securely clip onto exterior edges of a container that holds painting supplies where the glasses and pockets can hold different colors of paint therein.

An attachable and detachable shot glass, can include a container having a front wall and a rear wall, the rear wall tapering outward from an upper edge to a base, the rear wall having an elongated clip formed thereon for allowing the shot glass to securely clip onto exterior edges of a larger beverage container while keeping liquid contents in the shot glass level with liquid contents in the larger beverage container.

The elongated clip can have a generally convex curved outer side for matching to a concave curved lip of the larger beverage container. The elongated clip can have both a generally convex curved inner lip, and convex curved upper wall.

The rear wall can have a generally convex curved exterior surface and the front wall with a generally convex curved exterior surface.

The container can further include tapered sides for allowing the shot glass to be stacked with another shot glass.

The shot glass can have a height of approximately 1.801 inches, a depth of approximate 1.069 inches, and a rear wall having a length of approximately 2.461 inches.

The container can have a front convex shaped wall and a concave rear wall.

The larger beverage container can hold at least approximately 8 ounces of fluid. The larger beverage container can hold at least approximately 12 ounces of fluid. The larger beverage container can be a paper cup, coffee cup, and the like.

The shot glass can be formed from molded plastic. The shot glass can be formed from translucent material. The shot glass can be formed from paper. The shot glass can be formed from cardboard.

The shot glass can have an interior volume for holding approximately 2 ounces. The front wall can taper inward from the upper edge to the base. The rear wall can have a generally convex curved exterior surface and the front wall with a generally convex curved exterior surface. The elongated clip can have a generally convex curved outer side for matching to a concave curved lip of the larger beverage container. The elongated clip can have both a generally convex curved inner lip, and convex curved upper wall.

The shot glasses can be clipped about other containers, such as bowls, buckets, and the like, holding food products, such as yogurt, parfaits, ice cream, and the like, with the shot glasses holding toppings.

The shot glasses can be clipped about other containers holding painting supplies, such as paint brushes with the shot glasses holding different paint colors.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

The components of the figures will now be described.

Figure 1A:
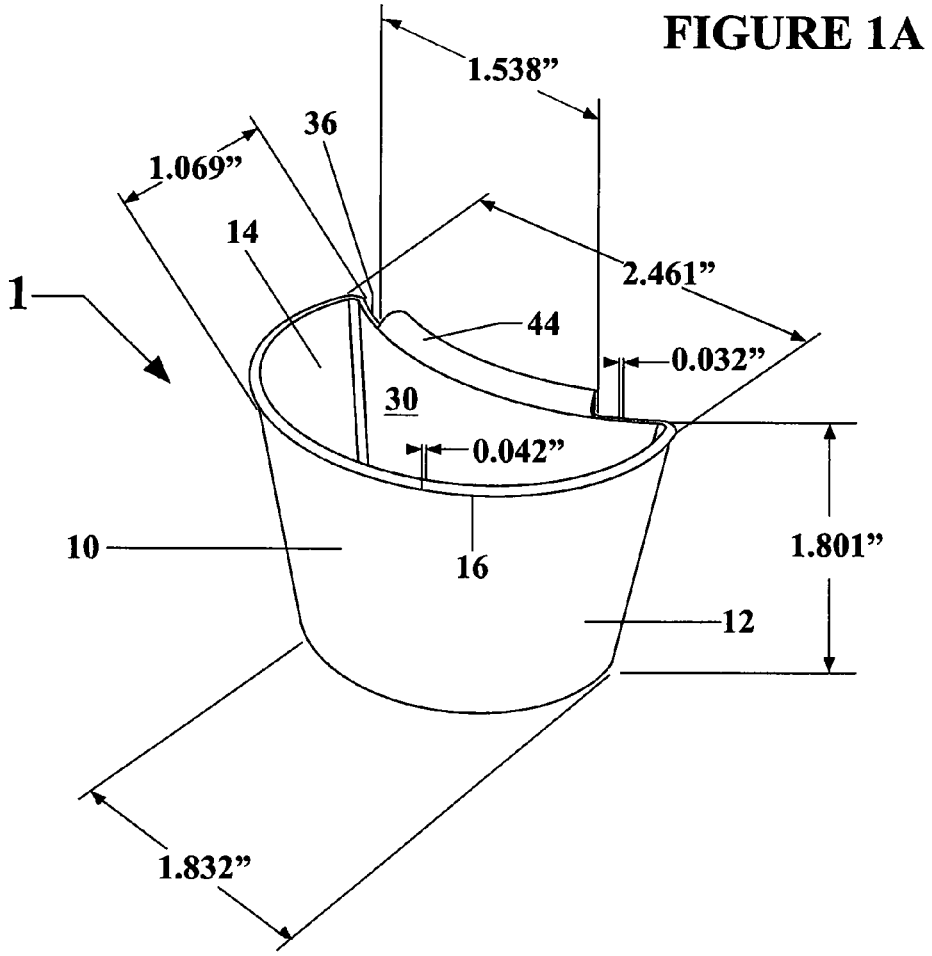
FIG. 1A is a front upper right perspective view of the attachable and detachable shot glass with clip formed on a rear side.
Figure 1B:
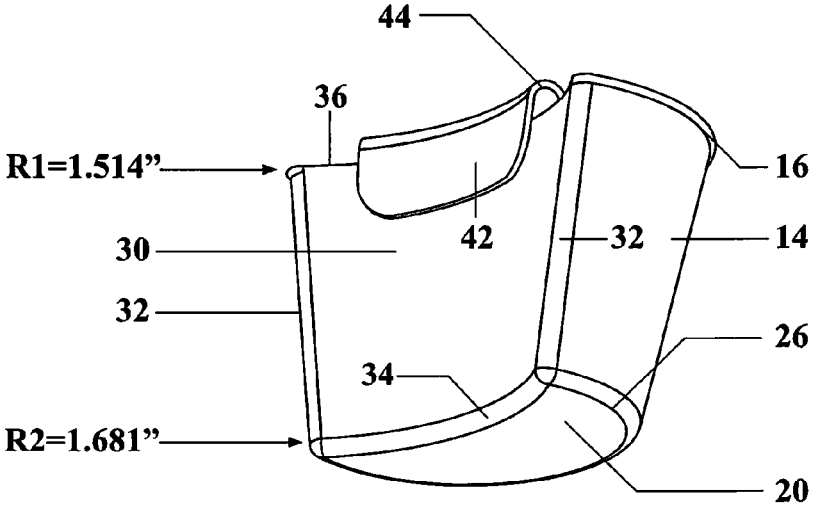
FIG. 1B is a rear lower right perspective view of the shot glass of FIG. 1A.
Figure 2A:
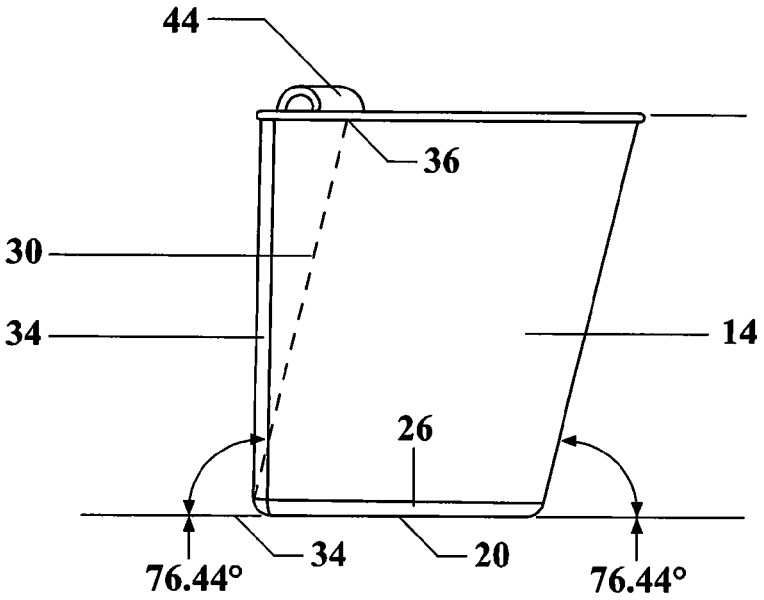
FIG. 2A is a left side view of the shot glass of FIG. 1A.
Figure 2B:
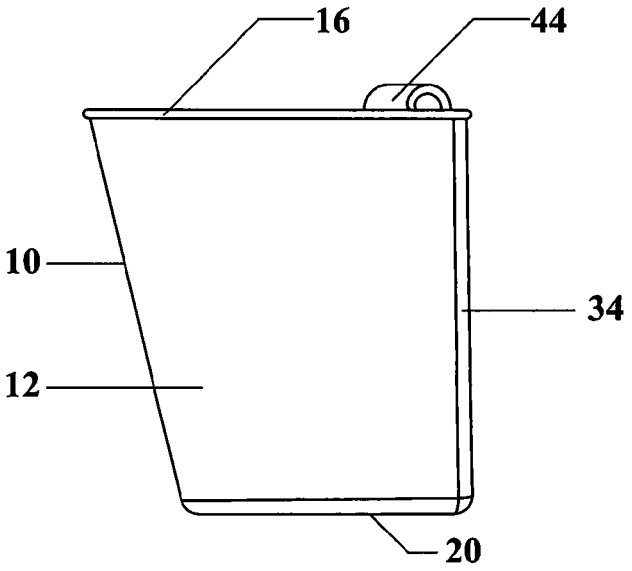
FIG. 2B is a right side view of the shot glass of FIG. 1A.
Figure 2C:
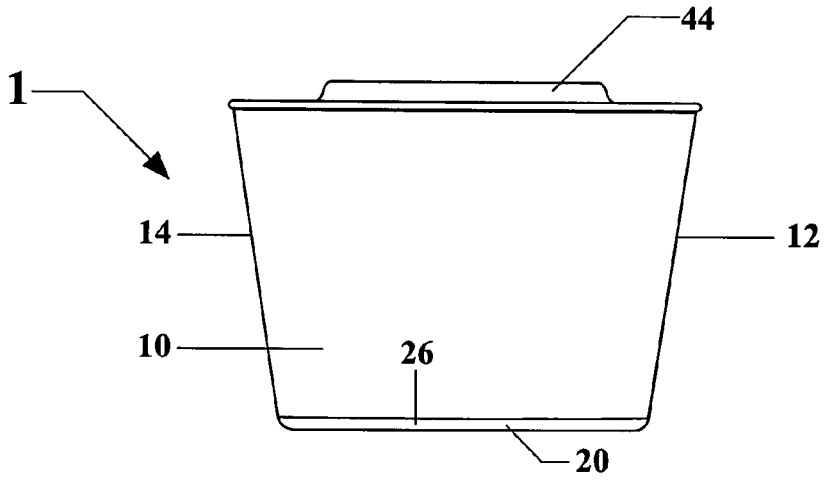
FIG. 2C is a front view of the shot glass of FIG. 1A.
Figure 2D:
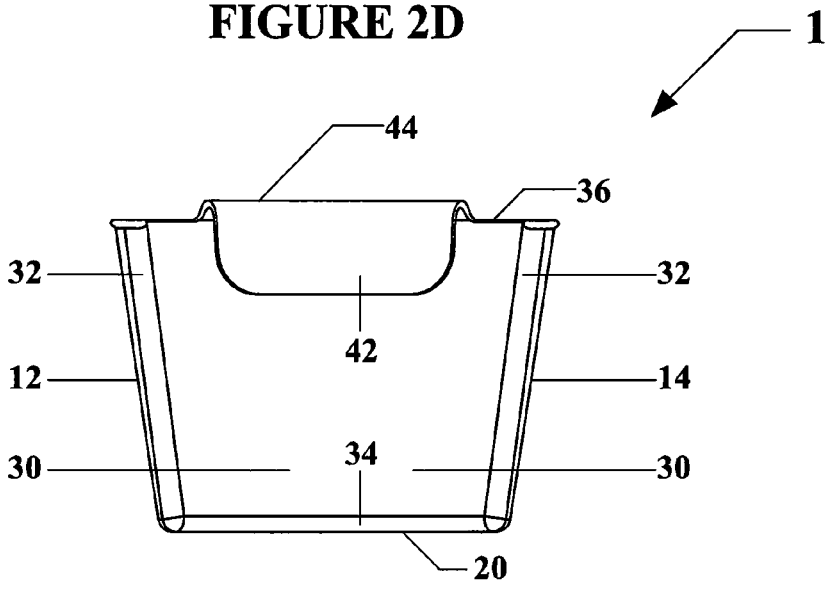
FIG. 2D is a rear view of the shot glass of FIG. 1A.
Figure 2E:
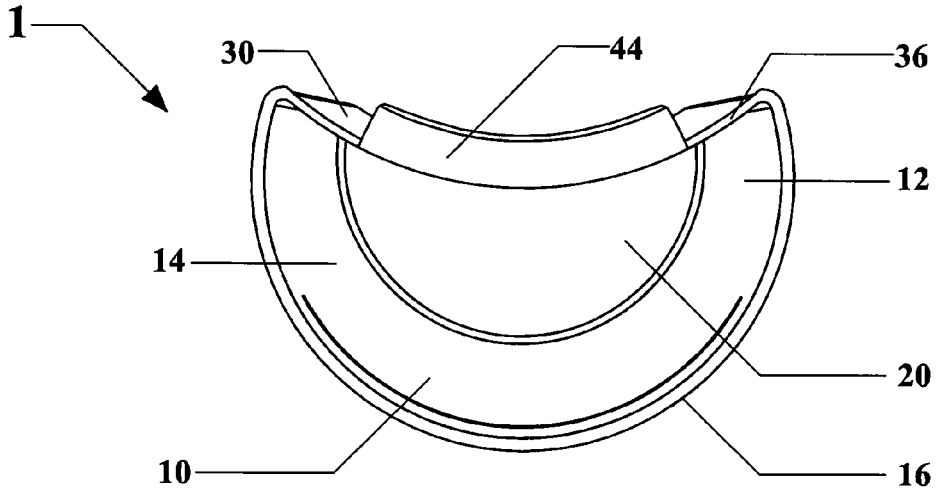
FIG. 2E is top view of the shot glass of FIG. 1A.
Figure 2F:
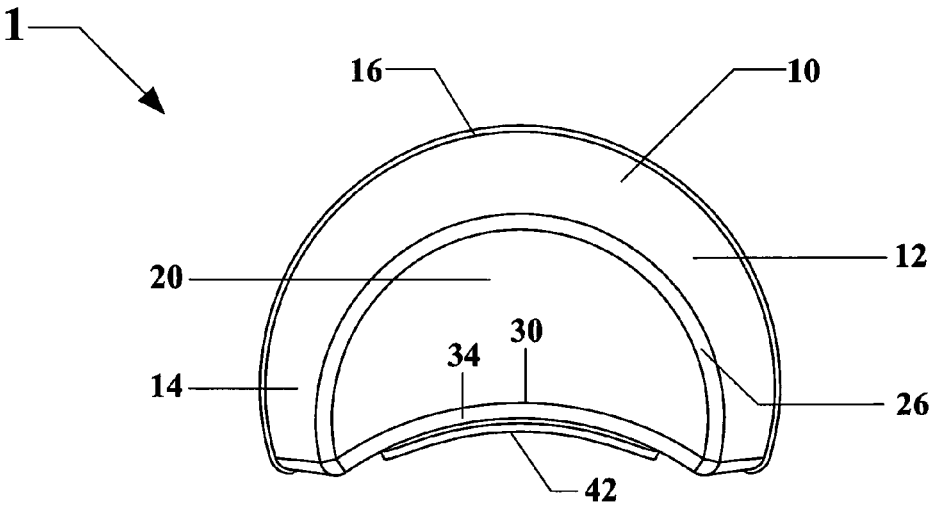
FIG. 2F is a bottom view of the shot glass of FIG. 1A.

1 shot glass
10 front convex curved wall tapers down to base
12 right convex curved wall
14 left convex curved wall
16 rim
20 base
26 edges
30 rear wall
32 side edges
34 bottom edge
36 upper edge
42 rear clip
44 upper curved edge of clip
100 beverage glass embodiment
110 inward tapering side walls of beverage glass
112 upper edge(rim) of beverage glass
200 coffee cup embodiment
210 inwardly tapering side walls of coffee cup
220 insulation sleeve on coffee cup
222 upper edge of insulation sleeve
300 parfait/yogurt container
310 sidewalls
312 upper edge(rim)
400 paint supplies container
410 sidewalls
412 rim
500 removable lid/cover embodiment
510 removable lid FIG. 1A is an upper front right perspective view of the attachable and detachable shot glass 1 with clip 42 formed on a rear side 30. FIG. 1B is a rear lower right perspective view of the shot glass 1 of FIG. 1A. FIG. 2A is a left side view of the shot glass 1 of FIG. 1A. FIG. 2B is a right side view of the shot glass 1 of FIG. 1A. FIG. 2C is a front view of the shot glass 1 of FIG. 1A. FIG. 2D is a rear view of the shot glass 1 of FIG. 1A. FIG. 2E is top view of the shot glass 1 of FIG. 1A. FIG. 2F is a bottom view of the shot glass 1 of FIG. 1A.

Referring to FIGS. 1A-2F, the shot glass 1 can include a front convex curved wall 10 with upper rim 16 which tapers down to base 20 (FIG. 2A) at an angle of approximately 76.44 degrees, and a right convex curved wall 12 which also tapers from upper rim 16 down to base 20, and left convex curved wall 14 with upper rim 16 which tapers down to base 20. The upper rim 16 can be slightly larger in thickness (approximately 0.042 inches) than the thickness (approximately 0.032 inches) of the front wall 10 and side walls 12, 14. The base 20 can have a substantially flat upper and lower surface with rounded curved edges 26. The rear wall 30 can be a concave curved wall with tapers outward from the upper edge 36 to lower edge 34 at an angle of approximately 76.44 degrees. The rear wall 30 can include a rear bottom edge 34 and the rear upper edge 36 can both have rounded edges and have a generally concave configuration. Extending rearwardly from the shot glass 1 can be a downwardly protruding clip 42 having an upper convex curved portion which attaches to a mid portion of the rear upper edge 36. The clip 42 can have a generally concave curved configuration being parallel to the concave curved rear wall 30.

The novel shot glass can have a height of approximately 1.801 inches, a thickness between rear convex curved wall 30 and exterior convex curved front wall 10 of approximately 1.069 inches, along the top of the shot glass 1. The width between the left side 14 and right side 12 of the upper portion of the shot glass 1 can be approximately 2.461 inches, which tapes down to a width between the left side 14 and the right side 12 on the bottom of the shot glass 1 of approximately 1.832 inches. The thickness of the walls of the shot glass can have a thickness of approximately 0.032 inches and the width of the rim 16 can have a thickness of approximately 0.042 inches. The term approximately can include +/−10% of the values listed. In addition the dimensions can be increased and decreased depending on the size of the shot glass application used.

The molded on upper edge 44 of the clip 42 can have a width of approximately 1.538 inches where the clip 42 is attached to the upper rear wall 36 of the shot glass 1, with the clip 42 having a rounded upper edge 44 and exterior facing tab portion having a length of approximately 1.366 inches, with the clip 42 having a generally convex curved shape parallel to the inner concave curved wall of the shot glass itself. The radius R1 of the upper rear edge 36 is approximately 1.514 inches and the radius R2 of the lower rear edge 34 is approximately 1.681 inches.

Referring to FIGS. 1A-2F, the novel shot glass 1 can be molded from clear translucent plastic, and have an interior volume that can hold approximately 2 ounces of liquid therein. The novel attachable/detachable shot glass 1 can be used as an easy to slide-on 2 ounce plastic shot glass, with a 1.75 ounce fill line, that introduces a simple up-sell opportunity for eating and drinking establishments which provide the ability to increase the sales of distilled beverage purchases. The novel attachable/detachable shot glass can create a conversation between the server and the patron about its appearance on the glass.

The novel attachable/detachable shot glass 1 has a unique ability to raise the visibility of any premium distilled beverage because it can be branded with any company's logo. The novel attachable/detachable shot glass 1 can be germane to any ancillary product that can go on a glass; it can be filled with distilled beverages, such as alcohol, as well as other beverages such as non-alcoholic beverages, including soda, juice, and the like, as well as specialty beverages, such as but not limited to energy drinks, and the like.

Figure 3A:
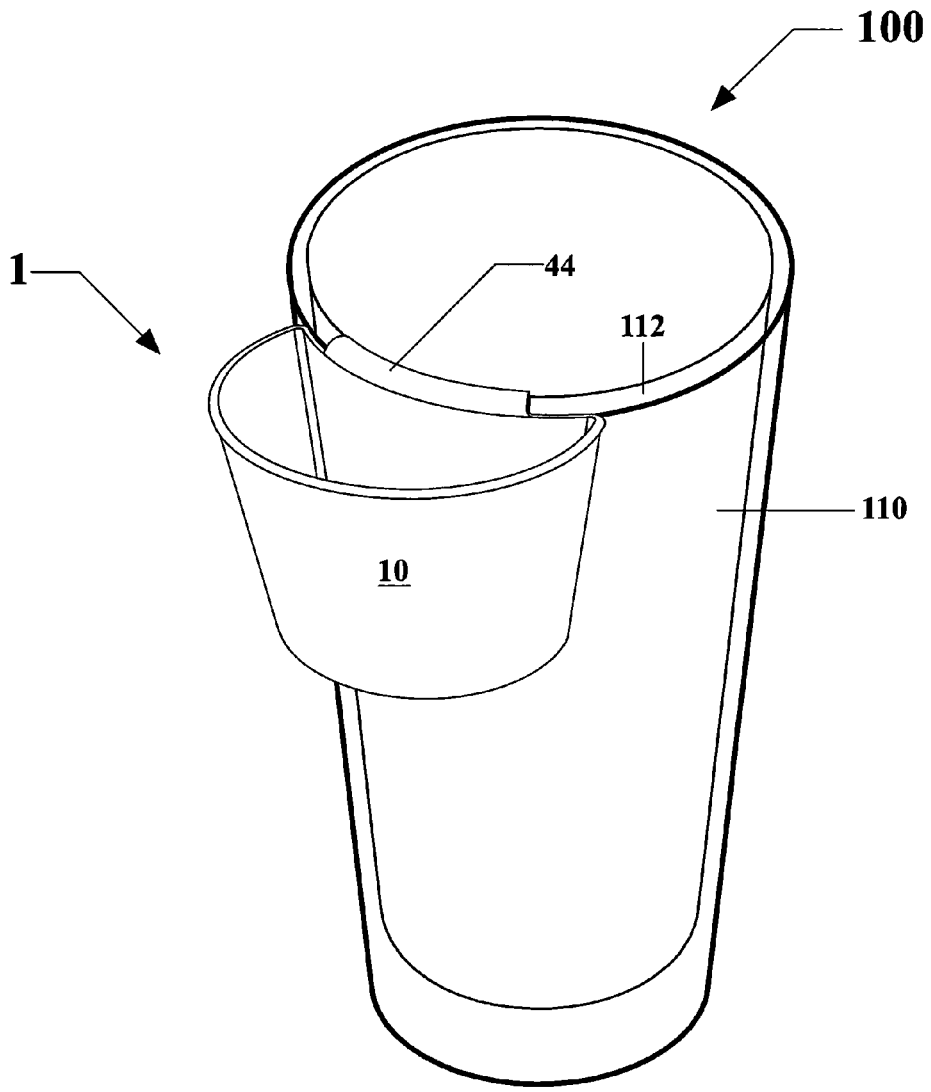
FIG. 3A is an upper perspective view of the shot glass of the preceding figures clipped to an upper edge of a large beverage glass.
Figure 3B:
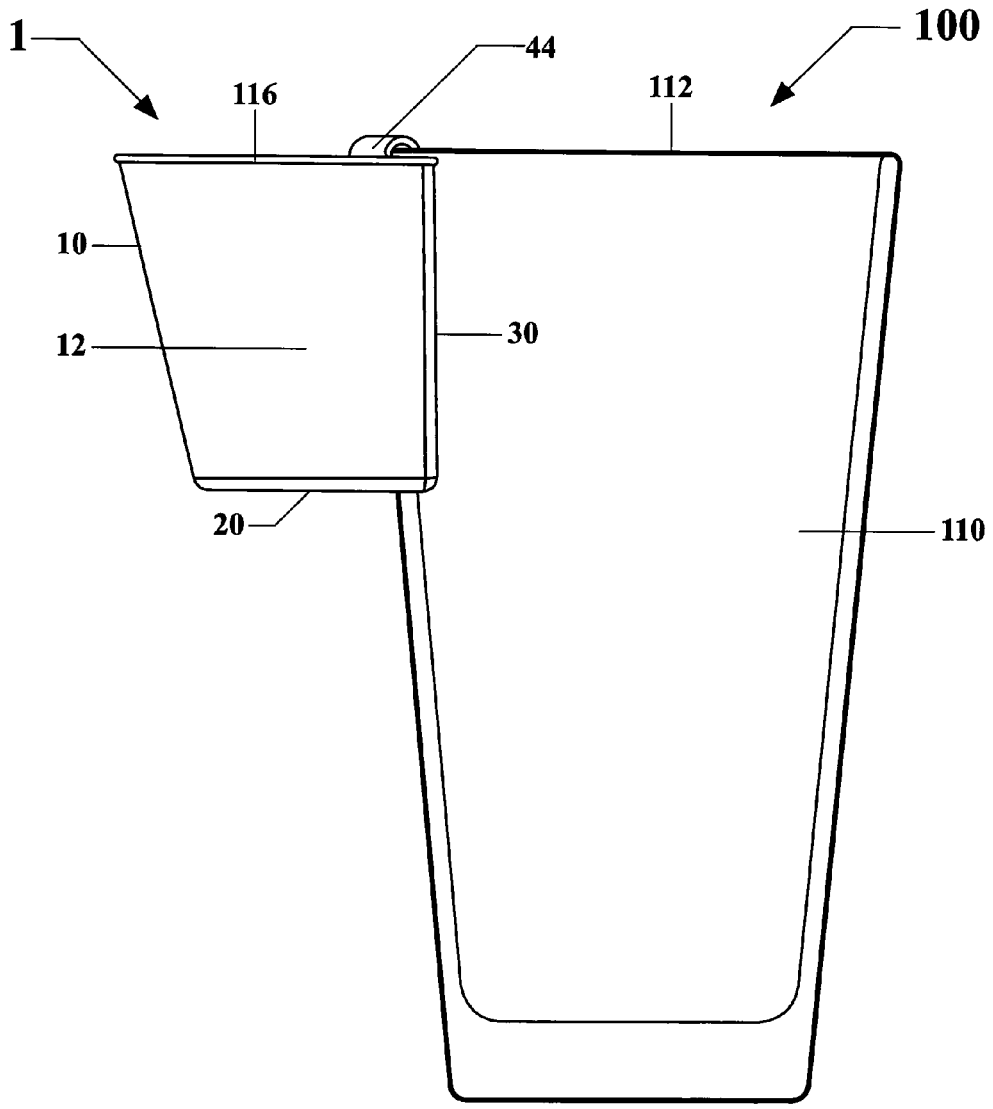
FIG. 3B is a side view of the beverage glass with clipped on shot glass of FIG. 3A.
Figure 3C:
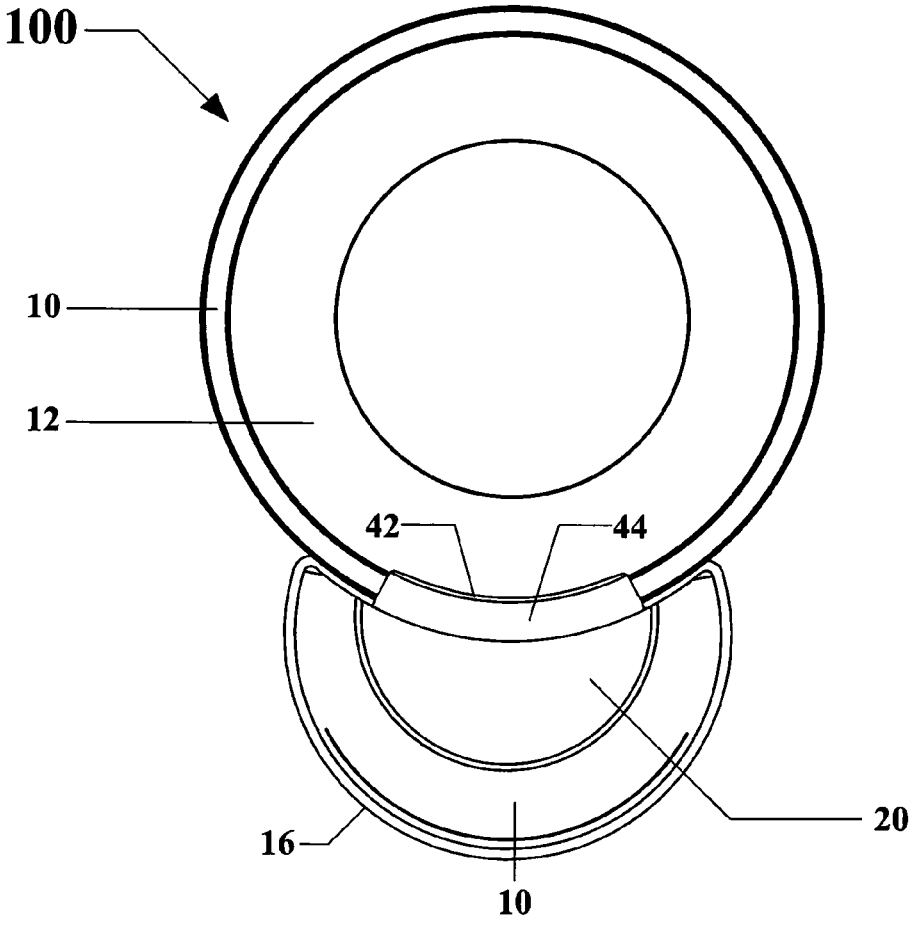
FIG. 3C is a top view of the beverage glass with clipped on shot glass of FIG. 3A.

FIG. 3A is an upper perspective view of the shot glass 1 of the preceding figures clipped to an upper edge(rim) 112 of a large beverage glass 100. FIG. 3B is a side view of the beverage glass 100 with clipped on shot glass 1 of FIG. 3A. FIG. 3C is a top view of the beverage glass 100 with clipped on shot glass 1 of FIG. 3A.

Referring to FIGS. 1A-3C, the shot glass 1 can be clipped on so that the upper portion 44 closely fits onto the rim 112 of the beverage glass 100 and the clip 42 fits into the upper edge of the side walls 110 of the beverage glass 110. The rear side 30 of the shot glass 1 which tapers outward from top to bottom rests against the inwardly tapering sidewalls 110 of the beverage glass 100. The novel configuration of the shot glass 1 allows for the rim 16 of the shot glass 1 to remain level with the rim 112 of the beverage glass 100 when the shot glass 1 is clipped onto the rim 112 of the beverage glass 100. This level arrangement is able to keep the contents in the shot glass 1 from spilling out, especially when the beverage glass 100 is transported with the shot glass 1 while both the beverage glass 100 and shot glass 1 are filled with liquids., such as when carried or on a serving tray and the like.

The larger beverage glass can be larger than an 8 ounce glass, 12 ounce glass, 16 ounce glass, 20 ounce glass, and the like, and be formed from glass material. Alternatively, the beverage glass can be formed from plastic, and the like, or cardboard, and the like, or some other variation of a paper product, and the like.

The novel attachable/detachable shot glass 1 can also be disposable and recyclable or the end-user can take it home as a souvenir/novelty.

The novel shot glasses are nestable with one another to allow for plural shot glasses to take up less storage space when not being used. The shot glasses can be stacked on top of one another with the base of one shot glass fitting into the upper opening of the shot glass below. The bottom edge of the clip of one shot glass can rest on the rim edge of a lower shot glass.

A novel step-by-step example of using the novel attachable/detachable shot glass will now be described.

1. The customer orders a beverage.
2. The bartender pours a beverage in a glass and slides on an empty attachable/detachable shot glass then serves it to the customer.
3. The customer asks about the empty attachable/detachable shot glass on the side of the glass thus giving the bartender the opportunity to up-sell with a premium shot of a distilled beverage.
4. The customer requests said premium shot to be added to the order.
5. The bartender pours the shot into the attachable/detachable shot glass while it is still on the side of the glass.
6. The customer removes the attachable/detachable shot glass from the side of the glass and drinks from the attachable/detachable shot glass.

The novel attachable/detachable shot glass has many unique features that include allowing for the shot glass to fit on any tapered beverage container. The novel attachable/detachable shot glass has a slide-on clip is designed with 1 degree of draft so the shot glass sits securely on the edge of a beverage container. The novel attachable/detachable shot glass can be made from FDA (Food and Drug Administration) approved plastic. The novel attachable/detachable shot glass can be designed to match the radius of the lip of any tapered beverage container. The novel attachable/detachable shot glass has can stand alone as a 2 ounce drinking container. The novel attachable/detachable shot glass has the ability to nest with itself for easy packaging.

The novel attachable/detachable shot glass can be branded by any company to promote their product. The novel attachable/detachable shot glass has as a softened edge on the radius of the drinking side.

Figure 4A:
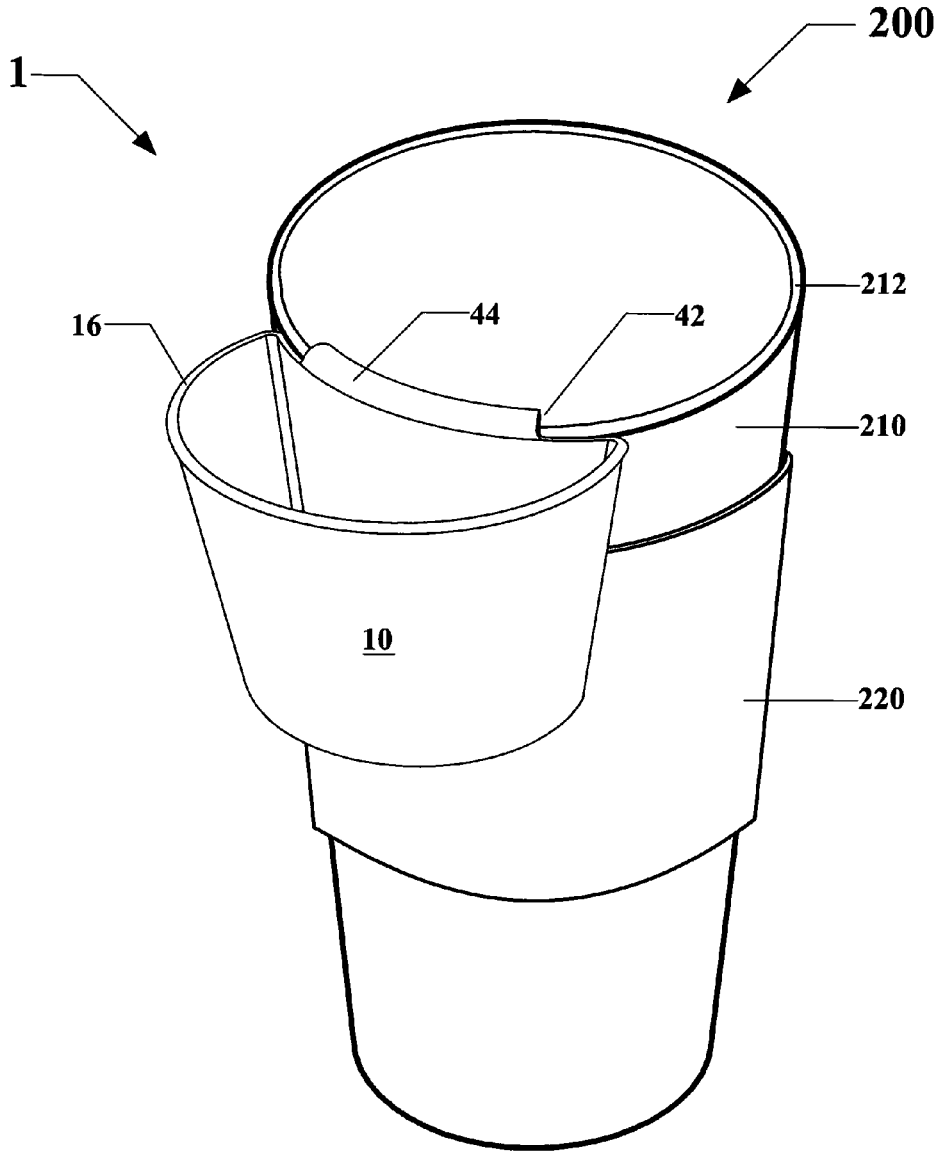
FIG. 4A is an upper perspective view of the shot glass of the preceding figures clipped to an upper edge of a coffee cup.
Figure 4B:
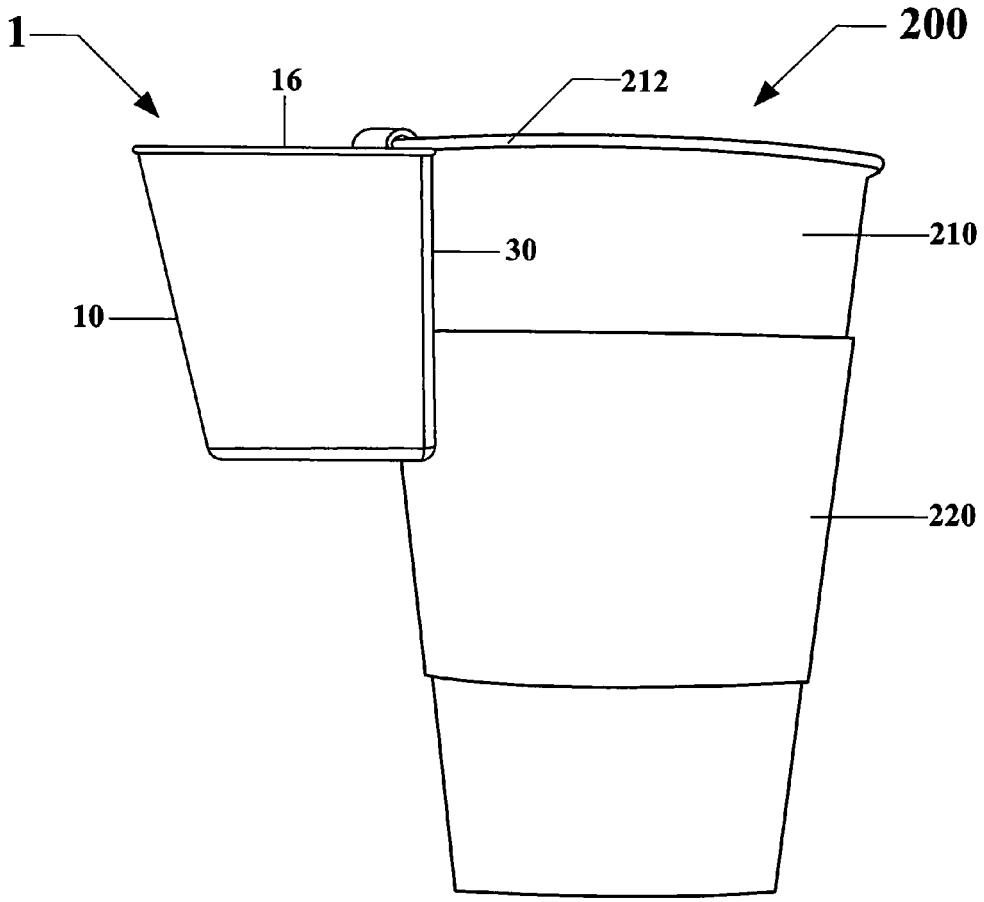
FIG. 4B is a side view of the coffee cup with clipped on shot glass of FIG. 4A.

FIG. 4A is an upper perspective view of the shot glass 1 of the preceding figures clipped to an upper edge of a coffee cup 200. FIG. 4B is a side view of the coffee cup 200 with clipped on shot glass 1 of FIG. 4A.

Referring to FIGS. 4A-4B, the plastic shot glass 1 of the preceding figures can be clipped on the upper edge(rim) 212 of a coffee cup 200, which has inwardly tapering side walls 210. The outwardly tapering rear wall 30 of the shot glass 1 can rest against the inwardly tapering side wall 210 of the coffee cup 200 allowing for both the rim 16 of the shot glass 1 to be level with the rim 212 of the coffee cup 200.

In this embodiment, the novel shot glass 1 can be used to hold cream, milk, other liquids and the like. Additionally, the shot glass 1 can hold condiments such as loose sugar or low calorie sweeteners, as well as packaged condiments and the like, as well as a stir. The cup 200 can be used for other beverages, such as but not limited to holding hot chocolate, tea, and the like As such, the shot glass 1 can hold other liquids such as lemon juice, tea bags, and the like.

In addition, the novel shot glass 1 can be used as a receptacle for light trash, such as used bags of sweeteners, a stir, new or used tea bag(s), napkins, and the like. While the cup is referred to a coffee cup, the cup can be a tea cup or any type of beverage cup, and the like.

Figure 5A:
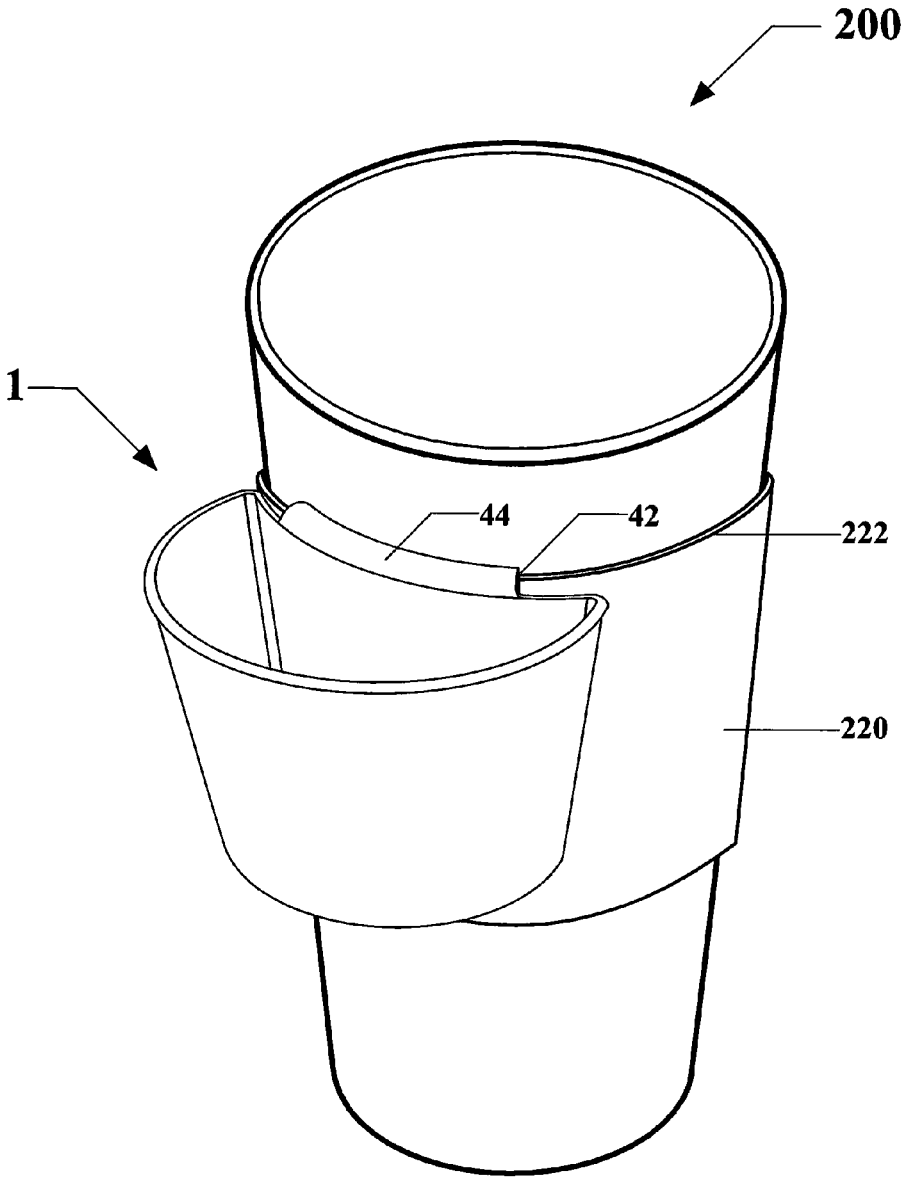
FIG. 5A is an upper perspective view of the shot glass of the preceding figures clipped to an upper edge of an insulation sleeve around a coffee cup.
Figure 5B:
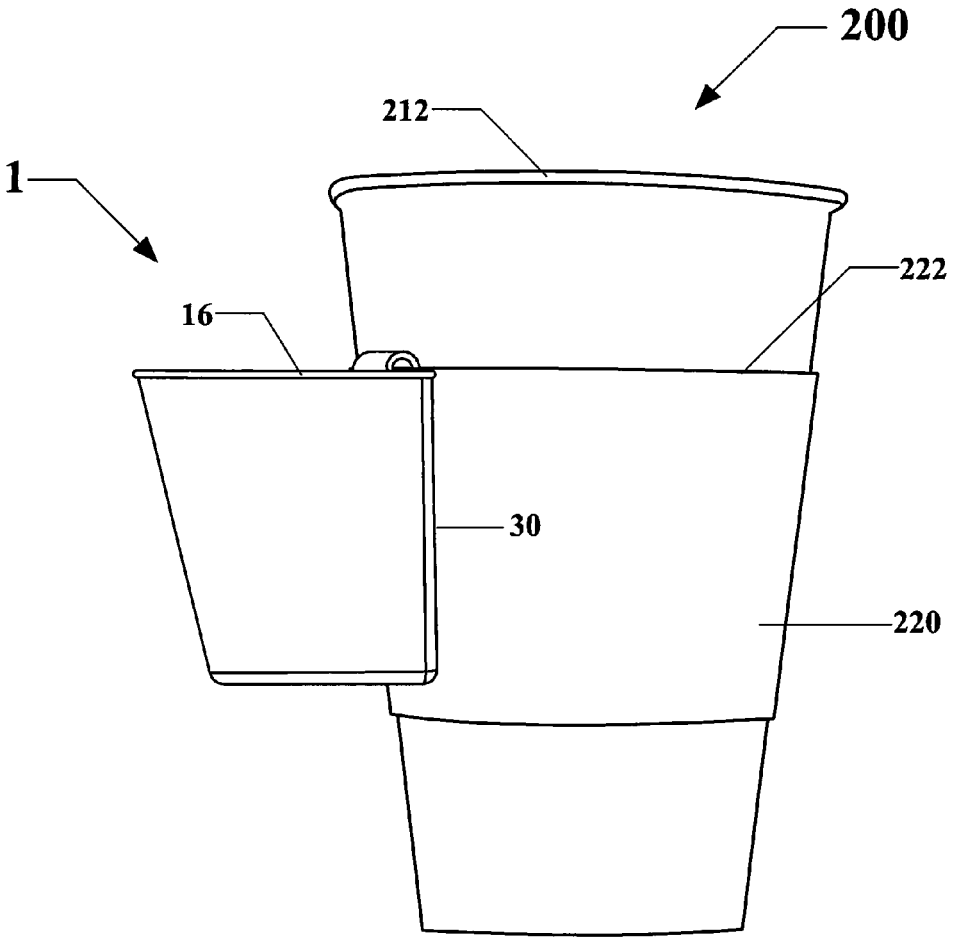
FIG. 5B is a side view of the coffee cup and sleeve with clipped on shot glass of FIG. 5A.

FIG. 5A is an upper perspective view of the shot glass 1 of the preceding figures clipped to an upper edge 222 of an insulation sleeve 220 around a coffee cup 200. FIG. 5B is a side view of the coffee cup 200 and sleeve 220 with clipped on shot glass 1 of FIG. 5A. When desired, the shot glass 1 can be clipped on the upper edge 222 of the insulation sleeve 220, and be used to hold liquids, and/or condiments, and/or utensils, such as a plastic or wood stir, spoon, and the like, as well as be a receptacle for loose trash.

Figure 6:
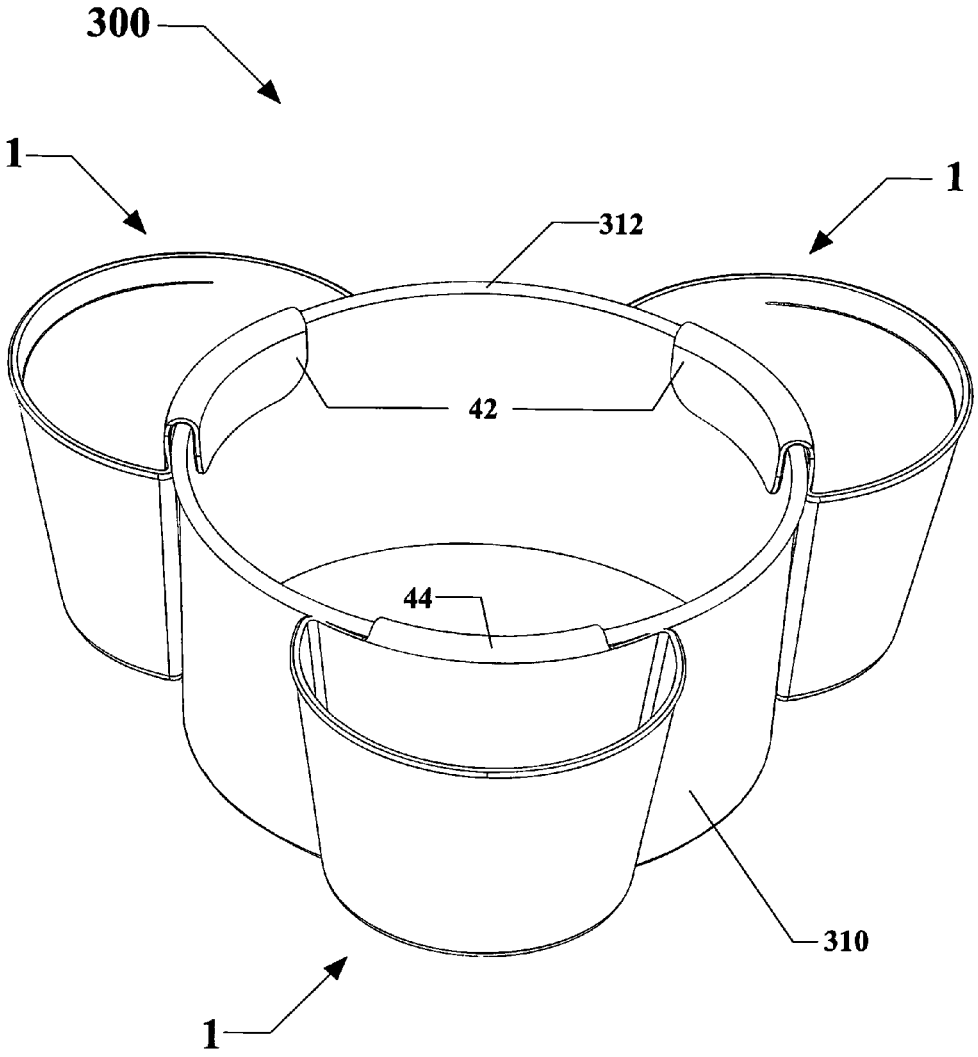
FIG. 6 is an upper perspective view of another embodiment with the shot glasses of the preceding figures attached about the rim of a yogurt/parfait cup.

FIG. 6 is an upper perspective view of another embodiment with the shot glasses 1 of the preceding figures attached about the rim 312 of a yogurt/parfait container 300, which can include a cup, bowl, and the like. The clips 42 overhang the side walls 310 of the cup 300. The cup 300 can be used to hold yogurt or parfait or ice cream or other deserts, foods, and the like. Each of the shot glasses 1 can hold different add-on toppings, and the like, such as but not limited to granola, chocolate, cherries, candy, and the like. Users can dispense the contents of the container 300 and selectively take different add-ons from each of the shot glasses 1.

Figure 7:
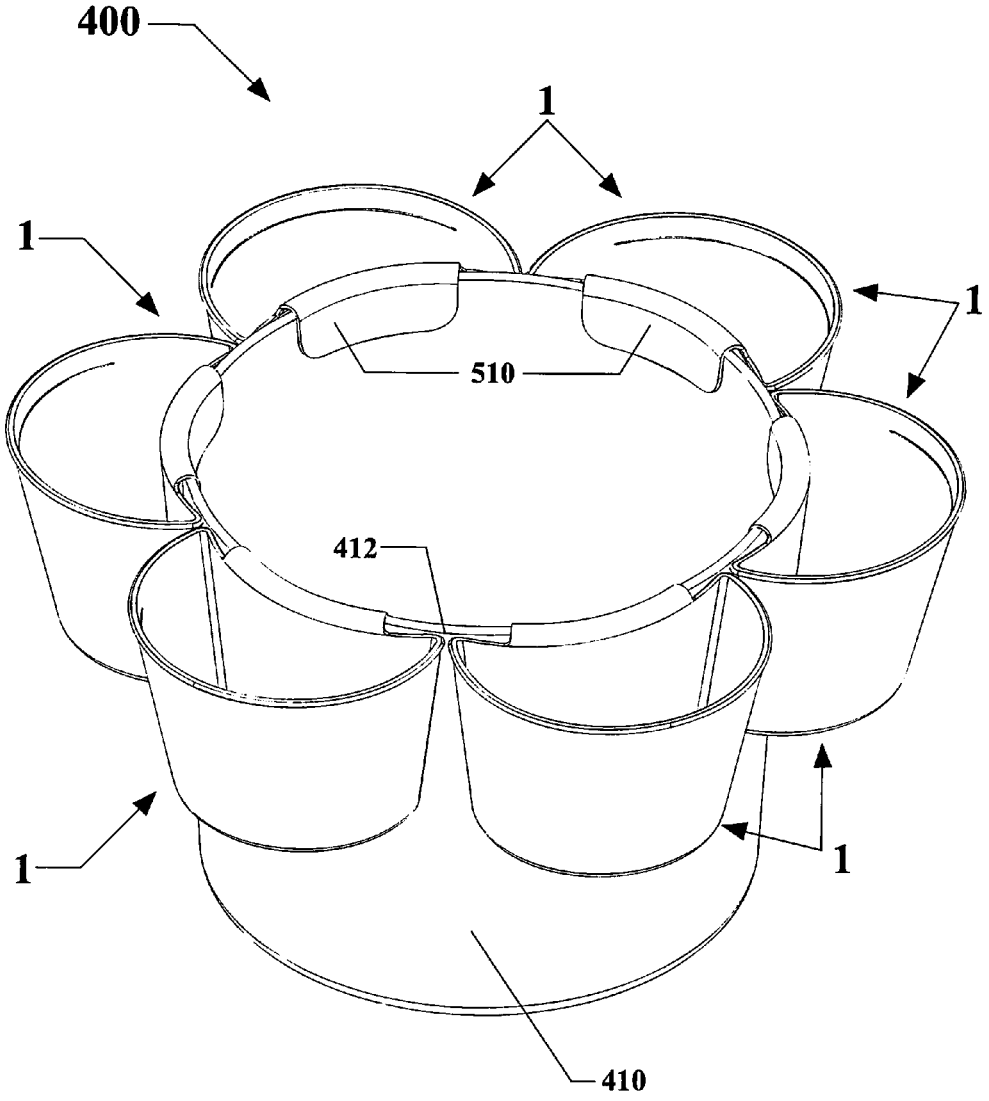
FIG. 7 is an upper perspective view of another embodiment with the shot glasses of the preceding figures attached about the rim of bowl holding painting supplies.

FIG. 7 is an upper perspective view of another embodiment with the shot glasses 1 of the preceding figures attached about the rim 412 of a container 400 such as a bucket, large bowl and the like, for holding painting supplies in the individual shot glasses 1. The inside of container 400 can hold supplies such as paint brushes, small squeezable paint holders, while the shot glasses 1 can each store different colors of paint, so that this embodiment can be used for different groups such as children, students and the like, as well as for a single artist.

Figure 8:
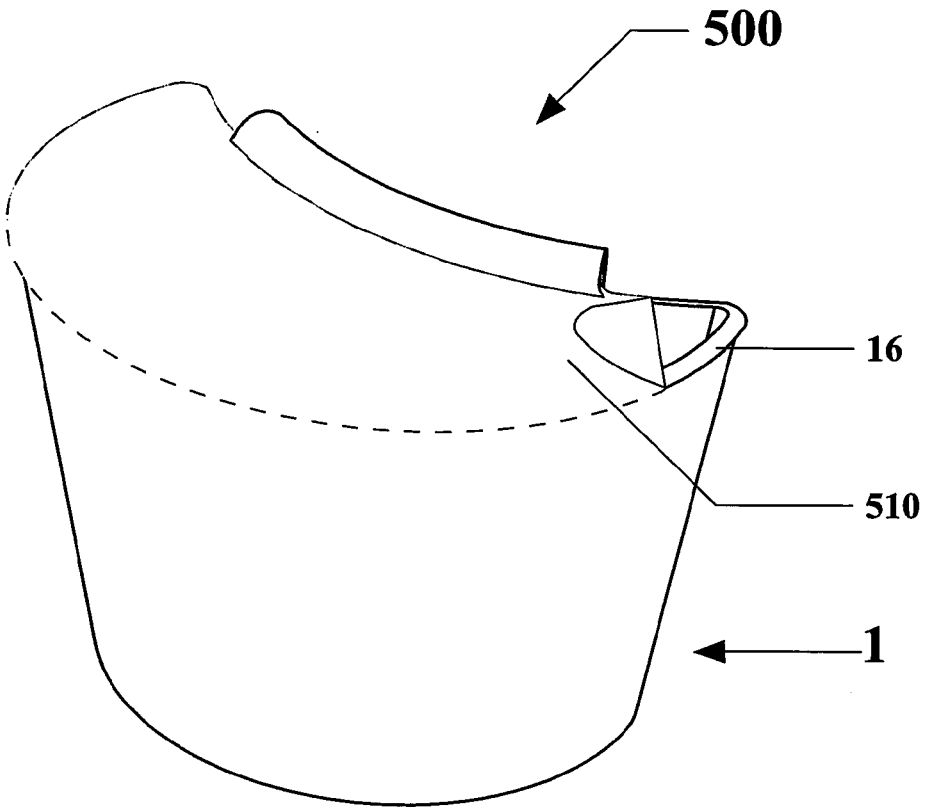
FIG. 8 is an upper front perspective view of the shot glass of the preceding figures with a removable lid.

FIG. 8 is an upper front perspective view of a covered shot glass embodiment 500 the shot glass 1 of the preceding figures with a removable lid 510 that can be removed by being peeled off and the like. The lid 510 can be formed from a water proof type paper used with small creamers, or be of other materials, such as but not limited to aluminum foil, and the like. The lid 510 can also be a snap on plastic lid, and the like. The covered shot glass 1 with lid 510 can store liquids, or solids inside, such as but not limited to food items, beverage items, condiments, and the like, as well as any other storable item, and the like.

Although the preferred embodiments describe the shot glass as being molded from plastic, the shot glass can be formed from glass material as well. The novel shot glasses can also be formed from paper material with or without a water sealing layer, as well as made out of cardboard material and the like.

While the rigid formed shot glasses formed from glass material, plastic, paper, cardboard, and the like, can be nestable with one another. The pliable materials such as paper, cardboard, and the like, can allow for the shot glasses to be flattened when not being used.

Although preferred sizes of the shot glasses are described above, the shot glass can be made smaller to hold as low as approximately an ounce of fluid or solid materials, as well as larger to hold a few ounces of liquid or materials as needed.

While the clip is described as being molded on the shot glass, the clip can be applied by fasteners, such as adhesives, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An attachable and detachable shot glass for holding beverage liquids, comprising:

a liquid beverage holding container having a front wall and a rear wall, the front wall having an upper convex curved exterior rim and a lower convex curved base exterior edge, the rear wall having an upper concave curved edge running from a left side corner to a right side corner with a length therebetween, the rear wall having a lower concave curved base edge running from the left side corner to the right side corner, the rear wall tapering outward from the upper concave curved edge to the lower concave curved base edge, the rear wall having a single elongated clip formed thereon, the elongated clip having an upper edge with a contiguous length between a left end and a right end, the length of the upper edge of the clip being shorter than the length between the left side corner and the right side corner of the upper concave curved edge so that the upper concave curved edge extends outward from both the left end and the right end of the clip, the clip for allowing the shot glass to securely clip onto convex curved exterior edges of a larger beverage container while keeping liquid contents in the shot glass level with liquid contents in the larger beverage container, wherein all of the rear wall between the left side corner and the right side corner of the holding container follows the convex curved exterior edges of the beverage container.

2. The shot glass of claim 1, wherein the container further includes tapered sides for allowing the shot glass to be stacked within another shot glass.

3. The shot glass of claim 1, wherein the shot glass includes a height of approximately 1.801 inches, a depth of approximately 1.069 inches, and a rear wall having a length of approximately 2.461 inches.

4. The shot glass of claim 1, wherein a larger beverage container includes: a large beverage glass holding more than 8 ounces of fluid.

5. The shot glass of claim 1, wherein a larger beverage container includes: a large beverage glass holding more than 12 ounces of fluid.

6. The shot glass of claim 1, wherein a larger beverage container includes: a paper cup or a coffee cup.

7. The shot glass of claim 1, wherein the shot glass is formed from molded plastic.

8. The shot glass of claim 1, wherein the shot glass is formed from translucent material.

9. The shot glass of claim 1, wherein the shot glass is formed from paper or cardboard.

10. The shot glass of claim 1, wherein the shot glass has an interior volume for holding between 1.85 ounces to approximately 2 ounces.

11. The shot glass of claim 1, wherein the front wall tapers inward from the upper edge to the base.

12. The shot glass of claim 1, wherein the tapering of the rear wall is approximately 76.44 degrees.

13. The shot glass of claim 1, wherein the length of the rear wall is approximately 2.461 inches, and the length of the clip is approximately 1.538 inches.

14. The shot glass of claim 1, wherein the single elongated clip includes:

a lower edge having a convex curved left corner and a convex curved right corner.

15. An attachable and detachable shot glass for holding beverage liquids, comprising:

a liquid beverage holder having a front wall and a rear wall, the front wall having an upper convex curved exterior rim having a radius of approximately 1.514 inches and a lower convex curved base exterior edge having a radius of approximately 1.681 inches, the rear wall having an upper concave curved edge running from a left side corner and a right side corner with a length therebetween, the rear wall having a lower concave curved base edge running from the left side corner to the right side corner, the rear wall tapering outward from the upper concave curved edge to the lower concave curved base edge, the rear wall having an elongated clip formed thereon, the clip for allowing the shot glass to securely clip onto exterior edges of a larger beverage container while keeping liquid contents in the shot glass level with liquid contents in the larger beverage container, wherein all of the rear wall between the left side corner and the right side corner of the holding container follows the convex curved exterior edges of the beverage container.

16. The shot glass of claim 15, wherein the tapering of the rear wall is approximately 76.44 degrees.

17. The shot glass of claim 15, wherein the shot glass has an interior volume limited to holding 1.75 ounces to approximately 2 ounces of liquid therein.

18. The shot glass of claim 15, wherein the length of the rear wall is approximately 2.461 inches, and the length of the clip is approximately 1.538 inches.

19. The shot glass of claim 15, wherein the container further includes tapered sides for allowing the shot glass to be stacked within another shot glass.

20. The shot glass of claim 15, wherein the elongated clip is a single elongated clip with an upper edge having contiguous length between a left end and a right end, and a lower contiguous edge between a convex curved left corner and a convex right corner.

* * * * *